US006948458B2

(12) United States Patent
Ariyakunakorn

(10) Patent No.: US 6,948,458 B2
(45) Date of Patent: Sep. 27, 2005

(54) TWO-WAY CYLINDER ENGINE

(76) Inventor: Amorn Ariyakunakorn, 2587 New Petchburi Road, Kwang Suanluang, Ket Suanluang, Bangkok 10250 (TH)

( * ) Notice: Subject to any disclaimer, the term of this patent is extended or adjusted under 35 U.S.C. 154(b) by 0 days.

(21) Appl. No.: 10/736,206

(22) Filed: Dec. 15, 2003

(65) Prior Publication Data

US 2004/0163618 A1 Aug. 26, 2004

(30) Foreign Application Priority Data

Feb. 12, 2003 (TH) ..... 080049

(51) Int. Cl.[7] ..... F02B 53/00

(52) U.S. Cl. ..... 123/43 AA; 123/241; 123/53.6; 123/56.1; 123/56.8

(58) Field of Search ..... 123/43 A, 43 AA, 123/53.6, 56.1, 56.8, 241, 245

(56) References Cited

U.S. PATENT DOCUMENTS 4,106,443 A * 8/1978 Triulzi ..... 123/43 R
4,944,261 A * 7/1990 Coates ..... 123/190.14
4,989,558 A * 2/1991 Coates ..... 123/190.14
5,103,778 A * 4/1992 Usich, Jr. ..... 123/56.8
5,813,372 A * 9/1998 Manthey ..... 123/43 A
6,601,548 B2 * 8/2003 Al-Hawaj ..... 123/56.1
6,672,263 B2 * 1/2004 Vallejos ..... 123/43 A

* cited by examiner

*Primary Examiner*—Sheldon J Richter
(74) *Attorney, Agent, or Firm*—Ladas & Parry

(57) ABSTRACT

An internal combustion engine wherein each cylinder has two pistons placed in the opposite direction and attached together by an arm-type connecting rod and wherein a cylinder head has a rotor blade rotating in the middle between the upper cylinder head and the lower cylinder head whereby the upper cylinder head and the lower cylinder head are perforated with an intake port and an exhaust port. The rotor blade is perforated with one port and rotates by a gear which is at the outer edge of the rotor blade. When the piston reaches the power stroke, it generates force to act on the arm-type connecting rod and when the connecting rod arm moves in a linear motion, it transmits the force towards the crankshaft or the transmission shaft which is attached by a guide rail platform.

21 Claims, 12 Drawing Sheets

TWO-WAY CYLINDER ENGINE

NATURE AND PURPOSE OF THE INVENTION

An engine having 2-sided pistons in a single cylinder and moving in a linear motion to reduce the lateral friction of the pistons with a view to providing the pistons to have less wear and tear and to move in a balanced motion by using less parts than an engine at present.

FIELD OF THE INVENTION

Engine engineering and engineering relating to engines.

BACKGROUND OF THE INVENTION

Four-stroke internal combustion engines which are in use today are subjected to development and improvement continually but their original power transmission form namely the pistons transmitting power to a connecting rod and towards a crankshaft cannot be developed. The movement of the pistons in an engine normally generates friction on a lateral side of the pistons which is the rolling radius side of a crank. The friction causes the pistons and the cylinder to undergo wear and tear and lose energy. Moreover, crankshafts which are in use today have light weight and the friction thus causes energy loss in a useless manner. When a close patent is taken into account such as U.S. Pat. No. 4,106,443 which relates to cylinder heads, there is great development nowadays. However, there are limitations in respect of the size and the number of valves which cause obstacles in the flow of an air-fuel mixture and exhaust gases. Previous development of cylinder heads has dealt with the development of spherical rotary valve assemblies as shown in U.S. Pat. Nos. 4,944,261; 4,989,558.

BRIEF SUMMARY OF THE INVENTION

The invention provides a new configuration of the cylinder head in which the conventional valve arrangement is replaced by a rotor which has openings communicating with intake and exhaust ports of the cylinder to control air-fuel intake into the cylinder and exhaust gases from the cylinder.

This results in a reduced number of parts and provides smooth flow of the air-fuel mixture and exhaust gases without obstruction by the valve face to such flow.

DETAILED DISCLOSURE OF THE INVENTION

Figure 1:
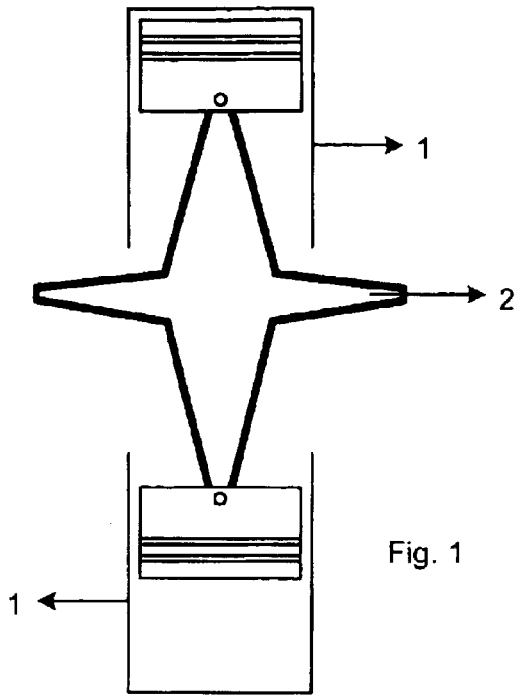
FIG. 1 A two-way cylinder and a balanced-arm type connecting rod.
Figure 2:
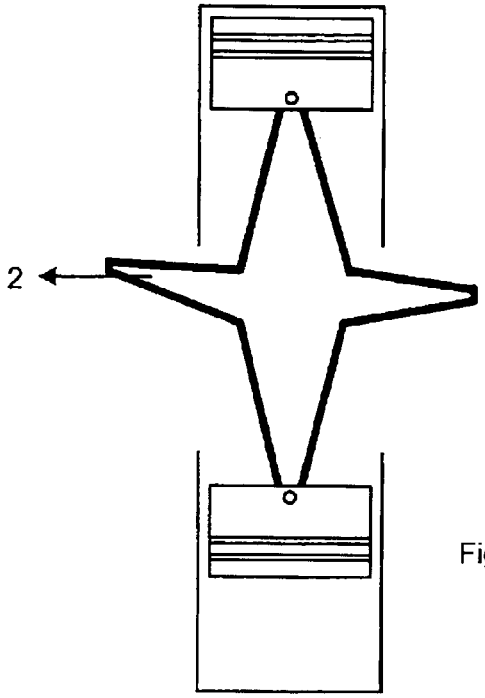
FIG. 2 A two-way cylinder and an oblique-arm type connecting rod in a model of an engine using a double parallel guide rail platform.
Figure 3:
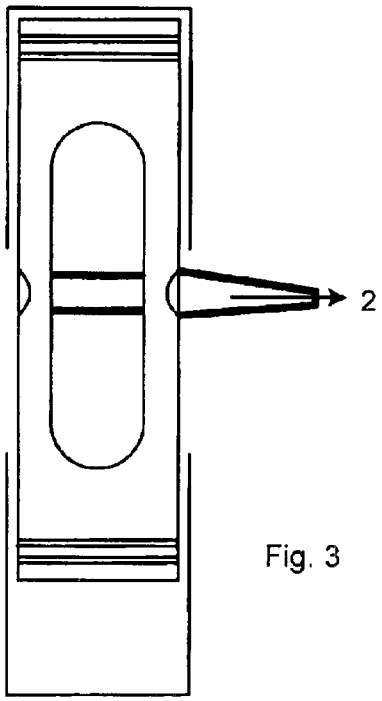
FIG. 3 A two-way cylinder and two-way pistons using a single arm type connecting rod.
Figure 4:
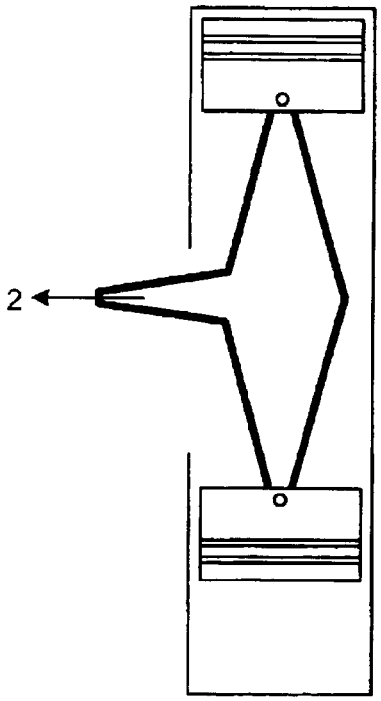
FIG. 4 A two-way and a single arm type connecting rod in a model of an engine using a single guide rail platform.

An object of the present invention is to allow the pistons to move in a linear motion only. The engine has separate pistons (FIG. 1) in upper and lower opposed positions or a two-way piston (FIG. 3) having chambers at the head and the tail of the two-way piston. The pistons in FIG. 1 are connected by a connecting rod to move together in a dual cylinder (1). The connecting rod has an extending arm 2 (hereinafter referred to as the connecting rod arm). The connecting rod arm (2) will transfer the power of the two pistons at a power stroke to the drive shaft with various forms of power transmission as follows:

A.1 It is designed to provide the transmission of power to one crankshaft only.

A.2 It is designed to provide the transmission of power to two crankshafts.

A.3 It is designed to provide the transmission of power to four crankshafts.

A.4 It is designed to provide the transmission of power to a drive shaft by a guide rail platform.

Figure 5:
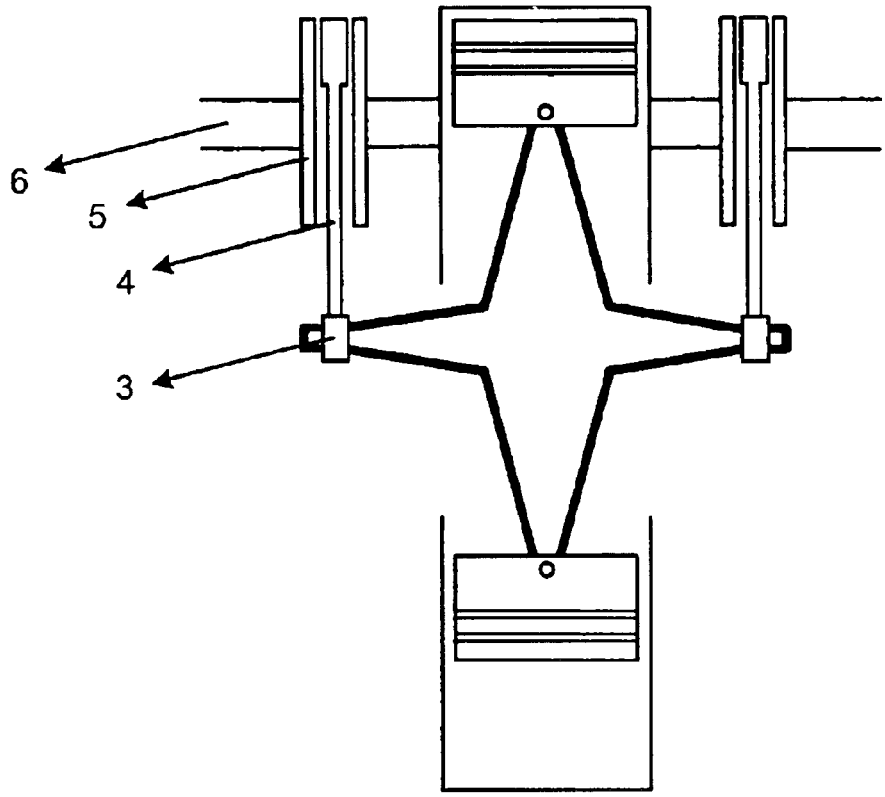
FIG. 5 A form of an engine with a one-shaft type two-way piston.
Figure 5:
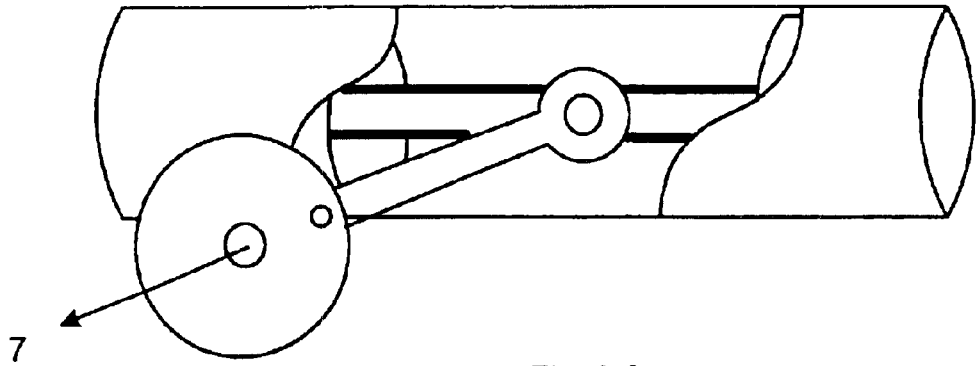
Figure 5:
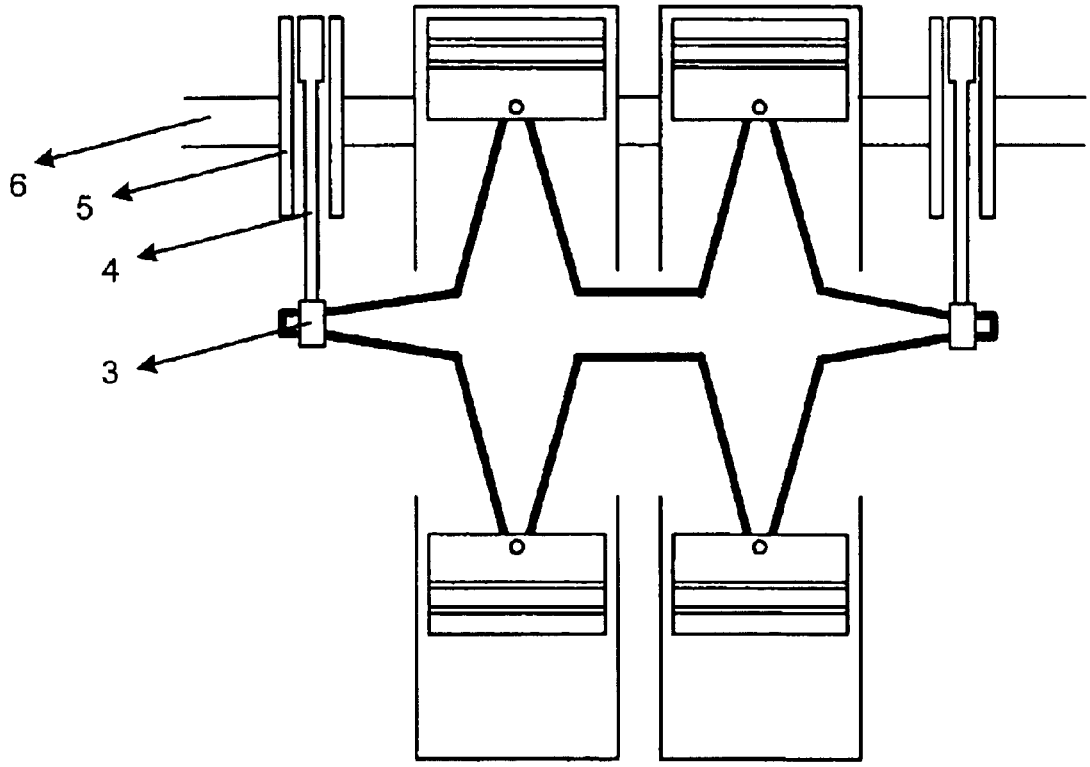
Figure 5:
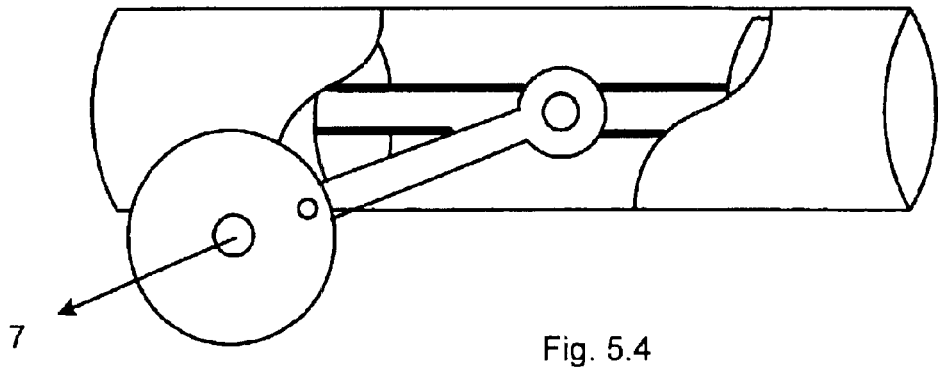
Figure 6:
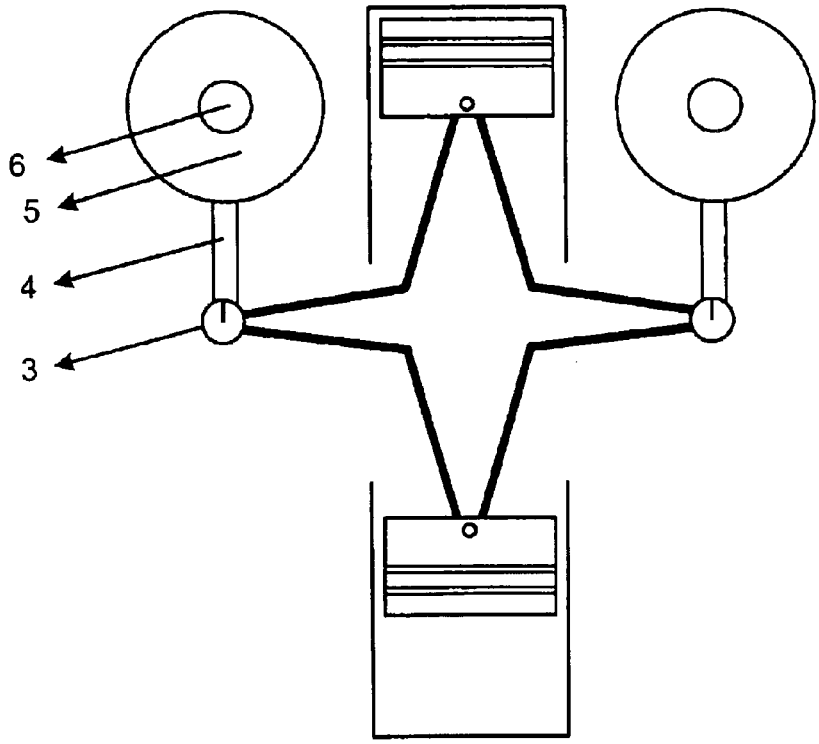
FIG. 6 A form of an engine with a 2-shaft type two-way piston.
Figure 6:
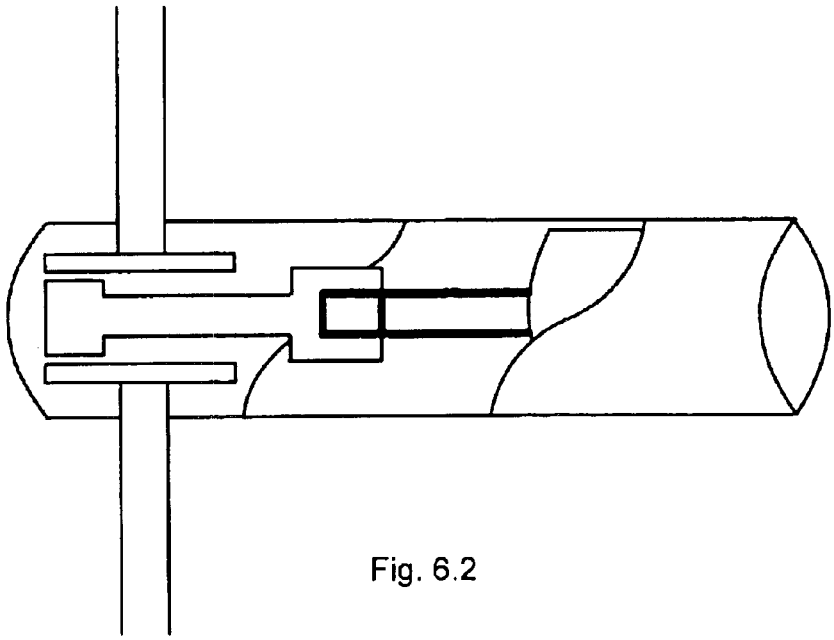

A.1 A design providing the transmission of power to one crankshaft by making a connecting rod arm (3) to be an axis for another connecting rod (4) to fit together and the connecting rod (4) joins a crank (5) by having a crankshaft (6) rotating horizontally opposing the line of the two-way cylinder which is in a horizontal direction (FIG. 5.1). The force derived from 2 pistons will be transmitted to the connecting rod arm at both sides in an equal amount thus causing the pistons to move in a balanced motion while the cranks at both sides which are connected to the double connecting rod arm can be designed to be light weight. The crankshaft which is fitted transversely will be eccentrically at the motion line of a connecting rod arm (7) and thus causing the crankshaft movement to sustain reduced friction.

A.2 A design providing the transmission of power to 2 crankshafts by making a connecting rod arm (3) to be an axis for another connecting rod (4) to fit together and the connecting rods (4) join a crank (5) by having crankshafts (6) rotating perpendicularly to the two-way cylinder while the crankshafts are separated in such a way that each crankshaft is at each side of the two-way cylinder along the connecting rod arm (6) and have synchronous rotations at both shafts.

Figure 7:
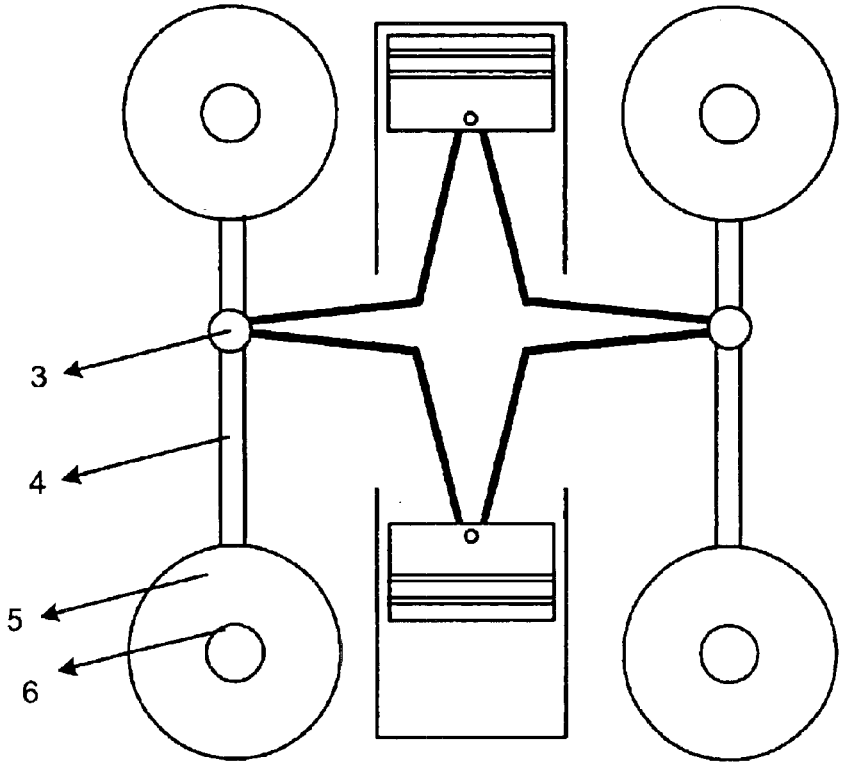
FIG. 7 A form of an engine with a 4-shaft type two-way piston.
Figure 7:
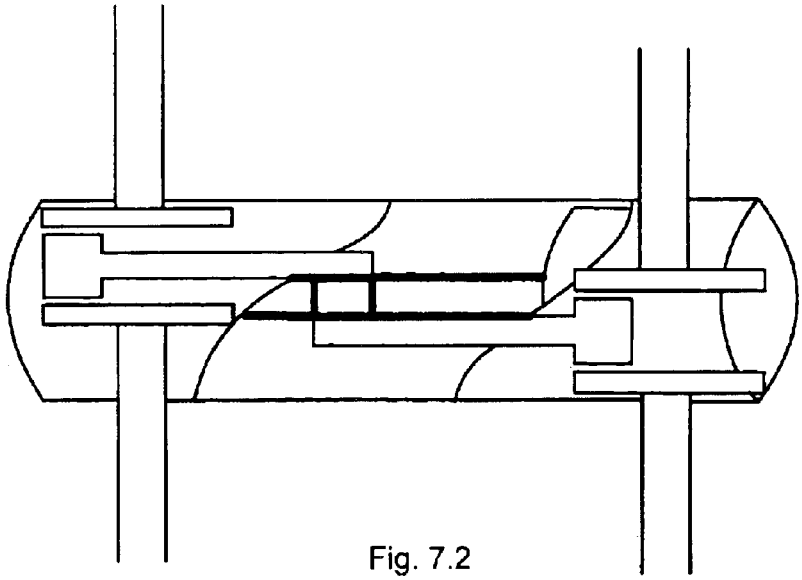

A.3 A design providing the transmission of power to 4 crankshafts by making a connecting rod arm (3) to be an axis for another two connecting rods (4) to fit together and the connecting rod (4) joins a crank (5) by having crankshafts (6) rotating perpendicularly to the two-way cylinder while the crankshafts are separated in such a way that two crankshafts are at each side along the connecting rod arm (FIG. 7) and thus causing the 4 crankshafts to have synchronous rotations in a balanced motion at all sides.

Figure 8:
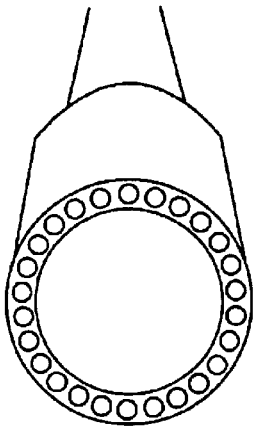
FIG. 8 The end of a connecting rod arm fitted with a ball sleeve.
Figure 12:
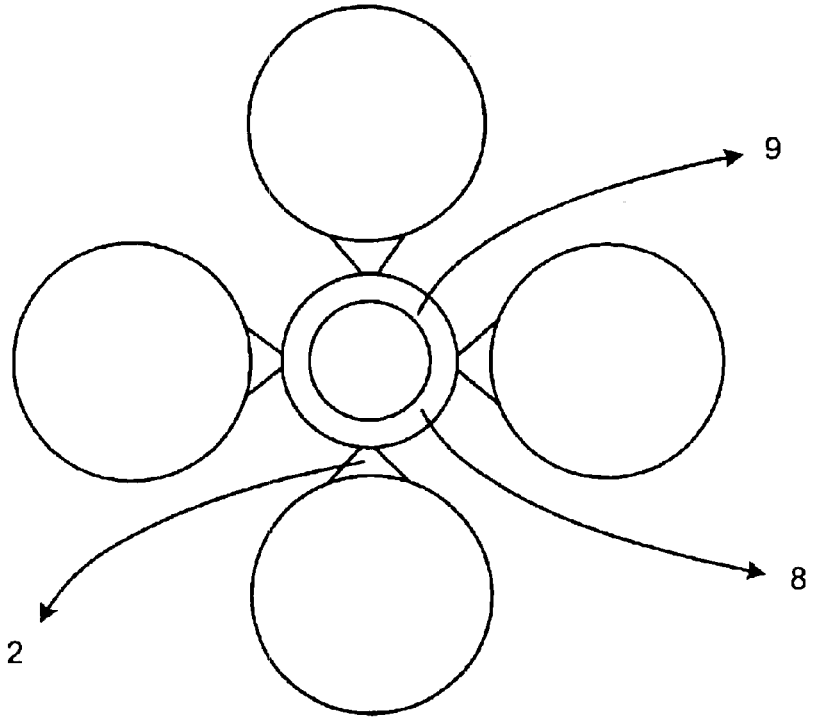
FIG. 12 A form of a 4-cylinder engine with two-way pistons using a guide rail platform.
Figure 16:
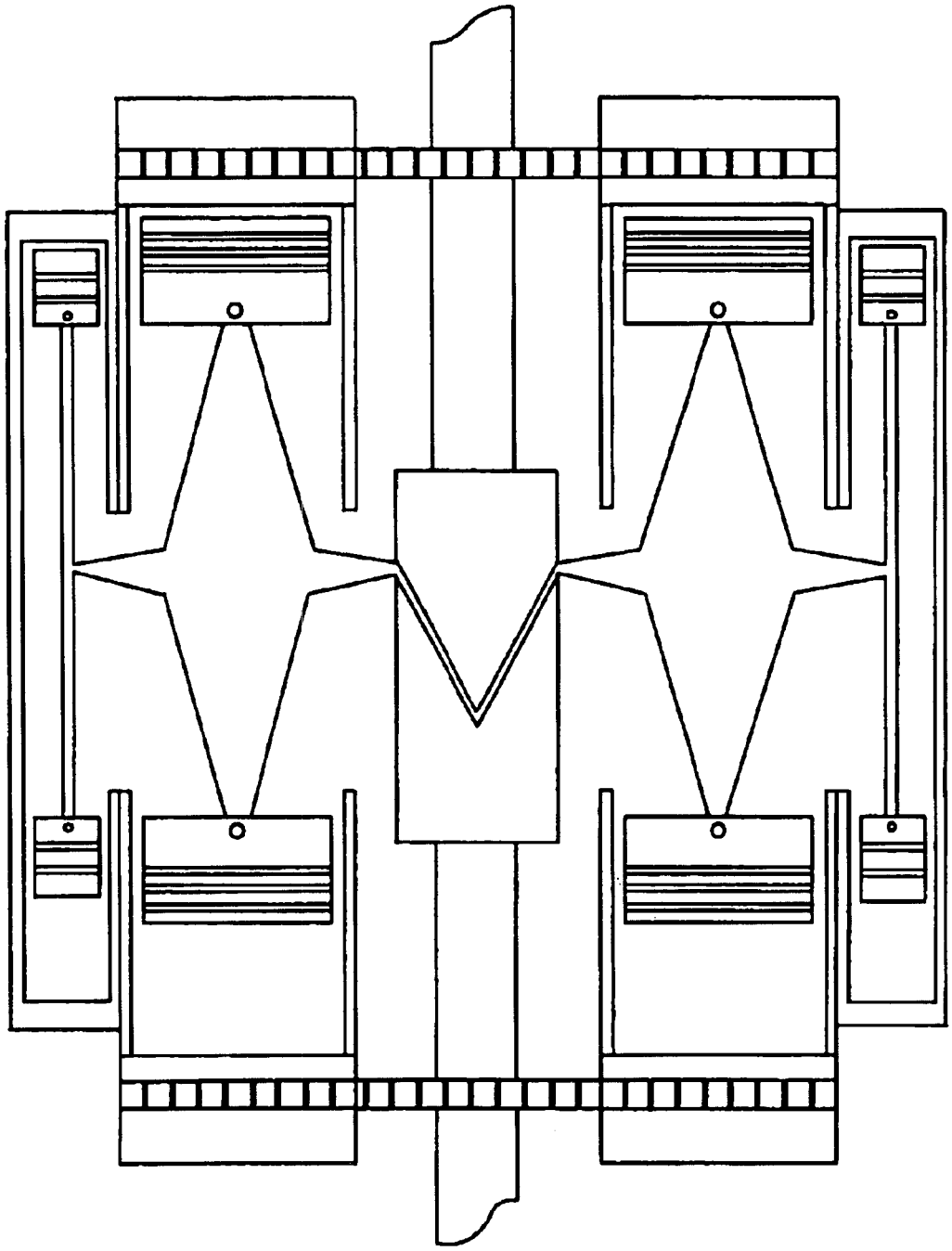
FIG. 16 A figure showing the detail of a 4-cylinder type two-way piston engine using a single guide rail platform and a balanced connecting rod arm.

A.4 A design providing the transmission of power to a drive shaft by a guide rail platform by making the end of the arm 2 of the connecting rod 1 to be a ball sleeve (FIG. 8). A transmission shaft (8) is tightly fitted with a guide rail platform (9). The transmission shaft is fitted parallel to the two-way cylinder whereas the connecting rod arm at the side where it is constructed as a ball sleeve is in the rail (10) of the guide rail platform (9) while the connecting rod arm at another side is fitted to a small connecting rod (FIG. 16) in a small two-way cylinder fitted laterally to the two-way cylinder which functions as an engine oil pump. It does not matter whether the connecting rod arm which is attached to the small connecting rod in the small two-way cylinder is present or not. The design to provide transmission to the drive shaft directly comprises one two-way cylinder or more. For the purpose of balance, at least 2 two-way cylinders should be fitted in the same plane and their clearance from both sides of the transmission shaft should be equal and this number can be increased to 4 cylinders with the transmission shaft being at the center surrounded by 4 two-way cylinders. Each cylinder has an equal clearance from the transmission shaft and forms an angle of 90 degrees, 180 degrees, 270 degrees and 360 degrees (FIG. 12). The end of the connecting rod arm of each two-way cylinder is in the rail of the guide rail platform with the pistons being placed alternately in each two-way cylinder.

Figure 13:
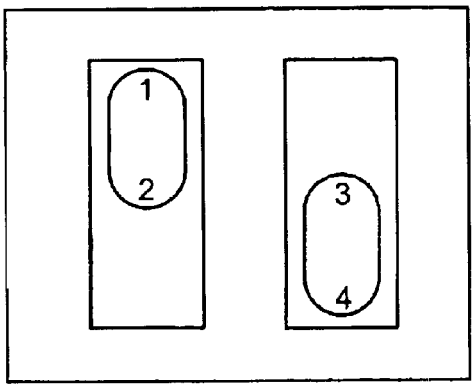
FIG. 13 A form of the positioning of the piston of a 2-cylinder type two-way piston engine.
Figure 13:
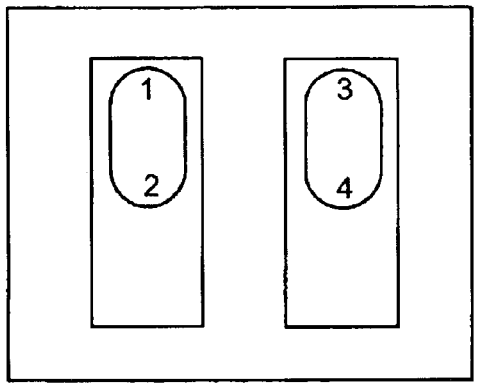

The Operation of a Linear Motion Piston is as Follows:

Referring to FIG. 13, the piston 1 is at the highest position, moving down to perform the intake stroke of the piston 1. When moving towards the lowest position, it ascends to perform the compression stroke and performs the power stroke when ascending to the highest position to generate power and descends to the lowest position and then ascends to perform the exhaust stroke. At the highest position, a new cycle begins. The movement to the highest and lowest positions also produces an effect on piston 2 on the opposite direction.

The ignition of piston 1 and piston 2 should be determined in successive positions. That is to say, after the piston 1 is at the highest ignition position when it descends, it means piston 2 begins to ascend. When the piston 1 is at the lowest position, the piston 2 is at the highest ignition position.

With the above principle, designs A.1, A.2, A.3 can work even with 1 two-way cylinder. If continuous operations and balance are required, there should be 2 or more two-way cylinders.

Regarding design A.4, there should be at least 2 two-way cylinders for balanced operations and 4 two-way cylinders for balanced and continuous operations.

Figure 14:
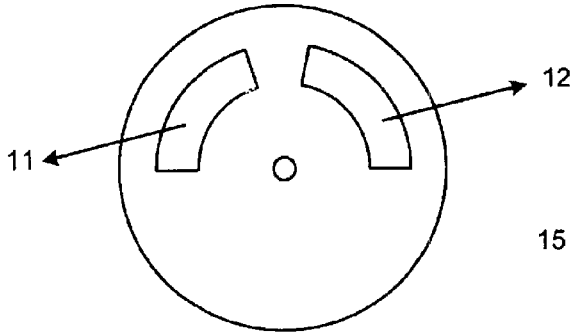
FIG. 14 A figure showing the detail of the cylinder head of an engine.
Figure 14:
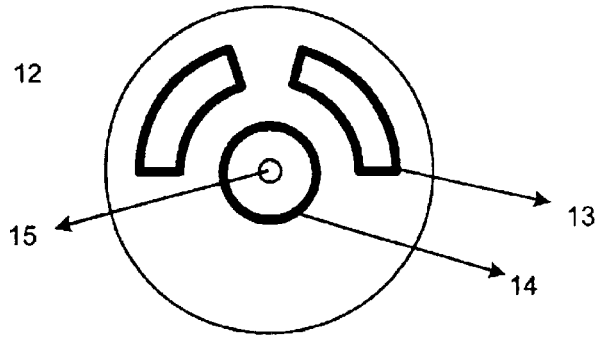
Figure 14:
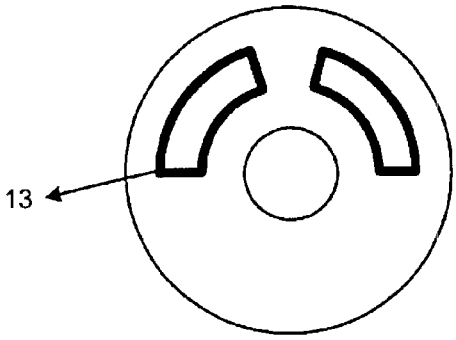
Figure 14:
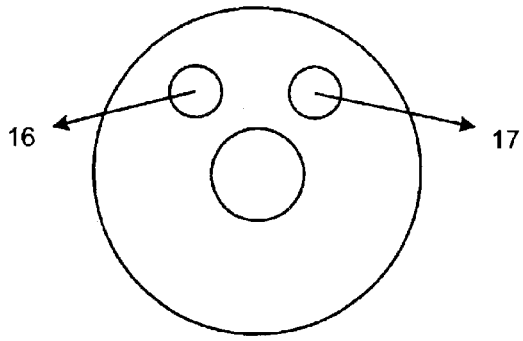
Figure 14:
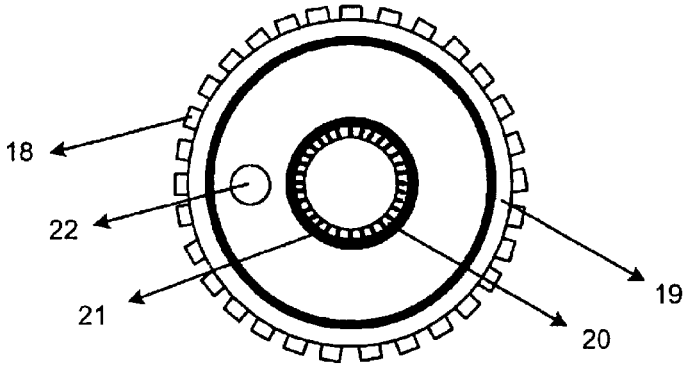
Figure 15:
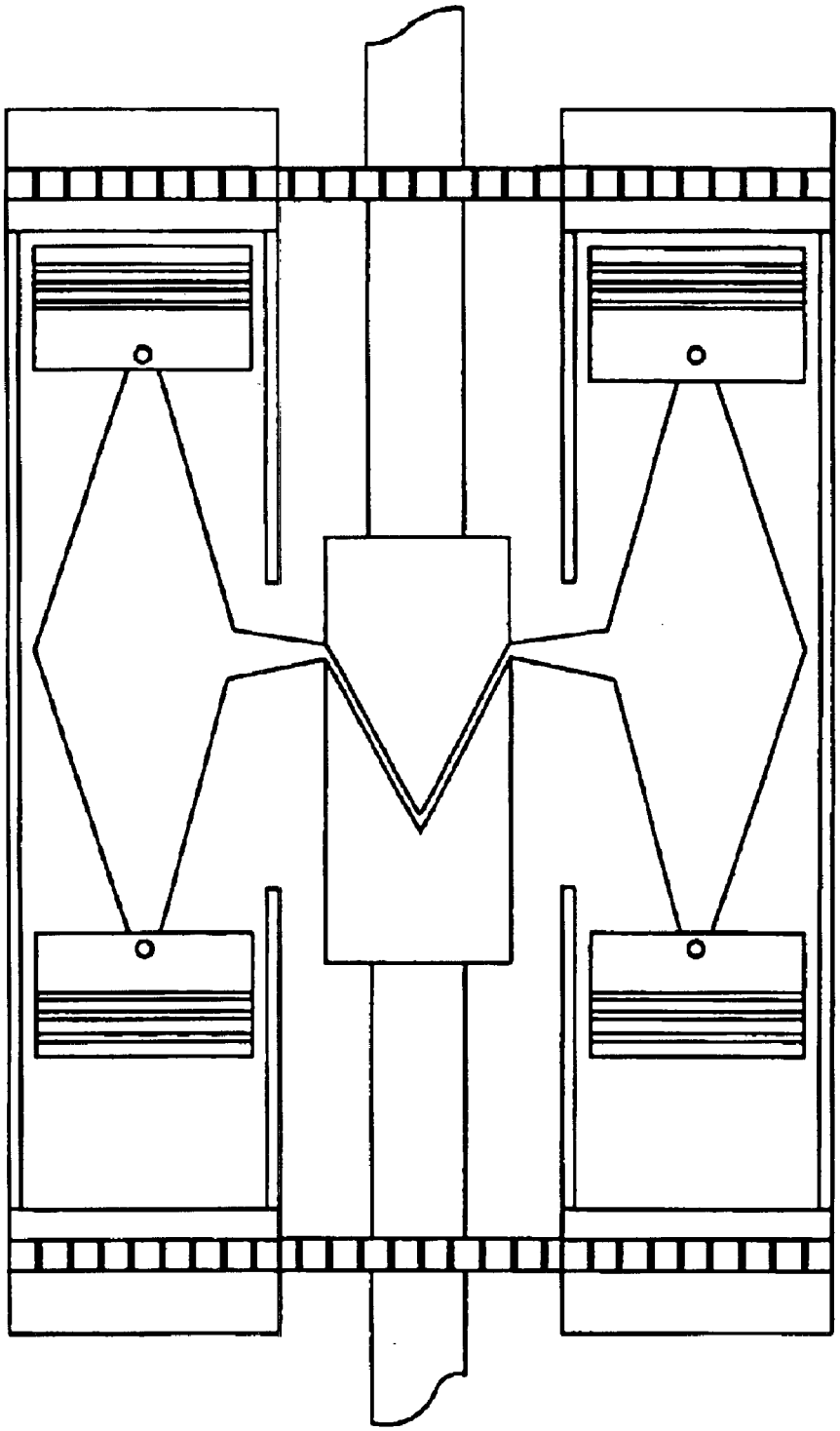
FIG. 15 A figure showing the detail of a 4-cylinder type two-way piston engine using a single guide rail platform and a single connecting rod arm.

The Operation of the New Piston is as Follows:

The cylinder head is constructed as 2 layers with a spherical rotor blade (FIG. 14.5) rotating between the upper cylinder head (FIG. 14.2) and the lower cylinder head (FIG. 14.3). The lower cylinder head (FIG. 14.1) is perforated with 2 ports whereby the two ports are on the hemisphere of the cylinder head sphere (FIG. 14.1). An intake port (12) and an exhaust port (11) of the upper cylinder head in contact with the rotor blade (FIG. 14.2) are provided with a seal (13) to prevent leakage pressure around both ports. The middle of the top of the lower cylinder head (FIG. 14.2) is constructed with an edge in high relief (14) with a port for a spark plug (15) while the high-relief edge is the core for a rotor blade. The rotor blade is of a circular nature with its outermost edge having gear teeth (18) to which a seal (19) is fitted to prevent leakage pressure at both sides of the rotor blade. The middle of the rotor blade is perforated with a hole having a size equal to the width of the high-relief edge of the lower cylinder head. The inner edge of the rotor blade is fitted with ball bearings (20) to reduce friction and a seal (21) prevent leakage pressure is fitted to the edge of ball bearings at both sides of the rotor blade. There is one port (22) perforated between the inner and outer sides of the leakage pressure prevention seal (FIG. 14.5). The lower cylinder head (FIG. 14.3) in contact with the rotor blade is perforated with an intake port and an exhaust port (FIG. 14.3) which is similar to the lower cylinder head and in the corresponding position. The edges of the intake port and exhuast port are fitted with a seal (13) to prevent leakage pressure. The upper part of the upper cylinder head is perforated to receive an intake port (17) and an exhaust port (16). The middle of the upper cylinder head is perforated with a hole having a size equal to the width of the high-relief edge of the lower cylinder head (FIG. 14.4).

When the lower cylinder head and the upper cylinder head have been assembled already, there is a space exactly fit the width of the rotor blade. The rotation between the rotor blade and gears (23) in designs A.1, A.2, A.3 has a gear ratio of 1:2. For design A.4, the gearing ratios are different between the fitting of 2 two-way cylinders which has a gear ratio similar to design A.1, A.2, A.3 and the fitting of 4 two-way cylinders which has a gear ratio of 1:1. The opening and closing of the flow of an air-fuel mixture and exhaust gases use a reduced number of parts and facilitate a better flow of an air-fuel mixture and exhaust gases. In operation, the parts of the rotor blade requires no special lubrication.

Operation of an Overall Engine

The design A.1 engine operate with only one two-way cylinder. If continuous power is required, 2 or more two-way cylinders should be used by fitting parallel and placing the pistons of each cylinder as per FIG. 13.1, FIG. 13.2.

Figure 17:
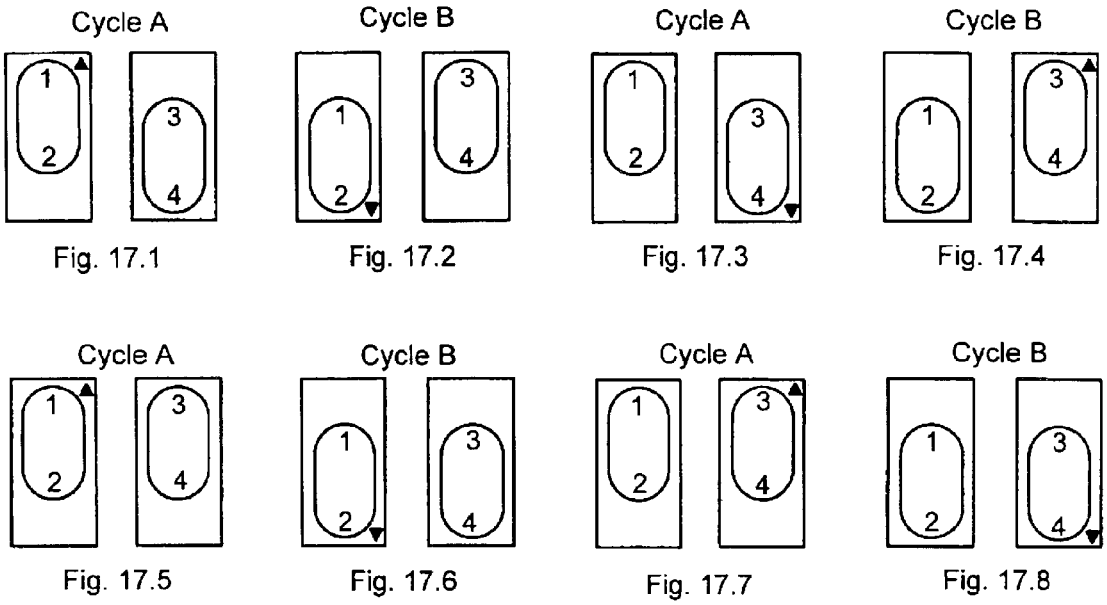
FIG. 17 A layout showing the position of the piston and the position of the ignition of a 2-cylinder type two-way piston engine.

FIG. 17.1, 17.3 Cycle A Pistons (1), (4) ascend to the highest positions Pistons (2), (3) descend to the lower positions FIG. 17.2, 17.4 Cycle B Pistons (2), (3) ascend to the highest positions Pistons (1), (4) descend to the lower positions FIG. 17.5, 17.7 Cycle A Pistons (1), (3) ascend to the highest positions Pistons (2), (4) descend to the lower positions FIG. 17.6, 17.8 Cycle A Pistons (2), (4) ascend to the highest positions Pistons (1), (3) descend to the lower positions FIG. 17.1 Piston (1) is at the ignition position.

FIG. 17.2 Piston (2) is at the ignition position.

FIG. 17.3 Piston (4) is at the ignition position.

FIG. 17.4 Piston (3) is at the ignition position.

FIG. 17.5 Piston (1) is at the ignition position.

FIG. 17.6 Piston (2) is at the ignition position.

FIG. 17.7 Piston (3) is at the ignition position.

FIG. 17.8 Piston (4) is at the ignition position.

The operation of the design A.1 engine which is a two-way cylinder type is one ignition per each cycle when the piston ascends to the highest position and descends to the lowest position and thus producing continuous torque down to the crankshaft. In fitting the crankshaft in the design A.1 engine, the center of the crankshaft with the motion line of the connecting rod arm should not exceed 45 degrees from the line of the two-way cylinder.

The design A.2 engine operates in the same manner as the design A.1 engine in all respects except the transmission of power to the crankshafts where there are 2 crankshafts perpendicular to the line of the two-way cylinder while the left crankshaft and the right crankshaft rotate synchronously.

The design A.3 engine operates in the same manner as the design A.2 engine in all respects including the transmission of power to the crankshafts. However, there is an additional crankshaft present at each side whereby the 4 crankshafts rotate simultaneously and synchronously.

The design A.4 engine which has 2 two-way cylinders operates in the same manner as the engines of designs A.1, A.2, A.3 in all respects.

The design A.4 engine which has 4 two-way single rail type cylinder operates as follows: (FIG. 18).

Figure 18:
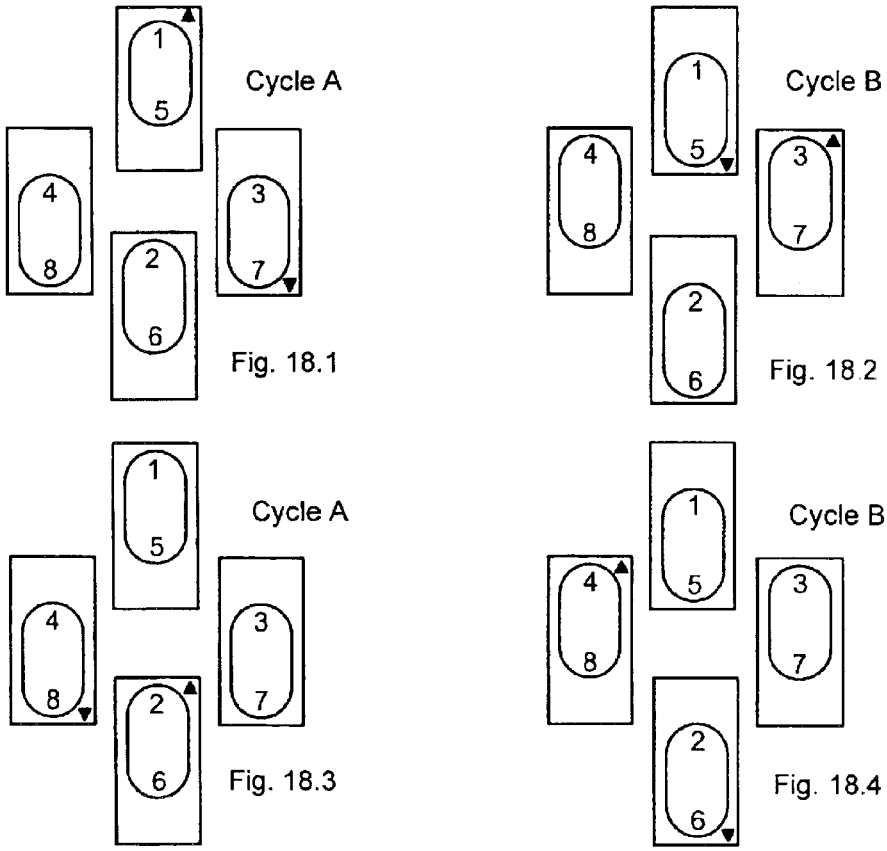
FIG. 18 A layout showing the position of the piston and the position of the ignition of a 4-cylinder type two-way piston engine using a single guide rail platform.

FIG. 18 Cycle A Pistons (1), (2) ascend to the highest point. Pistons (5), (6) descend to the lowest point.

Pistons (7), (8) ascend to the highest point. Pistons (3), (4) descend to the lowest point.

Cycle B Pistons (5), (6) ascend to the highest point. Pistons (1), (2) descend to the lowest point.

Pistons (3), (4) ascend to the highest point. Pistons (7), (8) descend to the lowest point.

FIG. 18.1 This causes piston (1) and piston (7) to be at the ignition position in cycle A.

FIG. 18.2 This causes piston (5) and piston (3) to be at the ignition position in cycle B.

FIG. 18.3 This causes piston (2) and piston (8) to be at the ignition position in cycle A.

FIG. 18.1 This causes piston (6) and piston (4) to be at the ignition position in cycle B.

The operation of the design A.4 engine which has 4 two-way single rail type cylinders is that in cycle A, each time there is ignition at two pistons in the opposite direction and in cycle B, each time there is ignition at two pistons in the opposite direction. This results in one rotation of the transmission shaft with 8 times of ignition from 4 two-way cylinders. The power obtained from the engine has continual high torque with reduced vibration.

Figure 19:
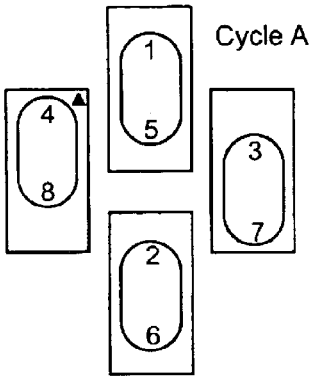
FIG. 19 A layout showing the position of the piston and the position of the ignition of a 4-cylinder type two-way piston engine using a double parallel guide rail platform.
Figure 19:
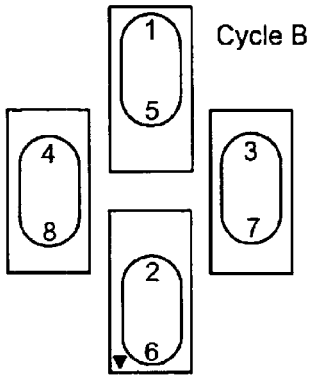
Figure 19:
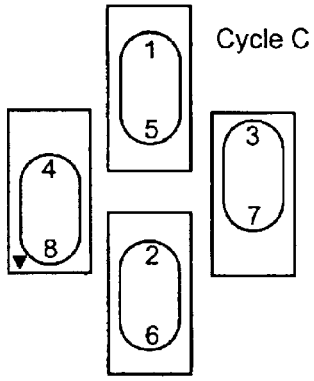
Figure 19:
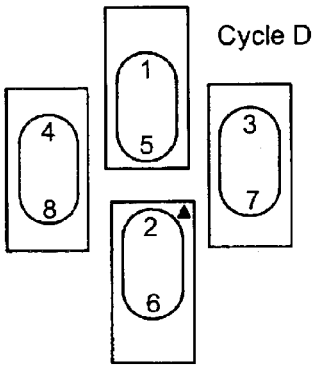
Figure 19:
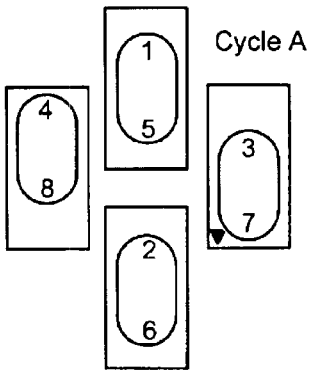
Figure 19:
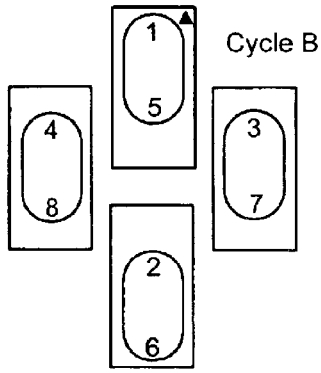
Figure 19:
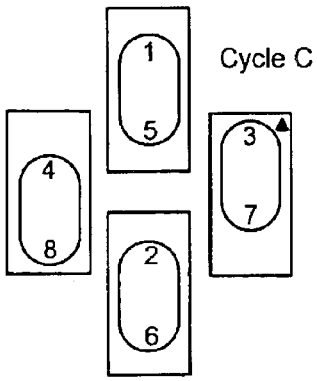
Figure 19:
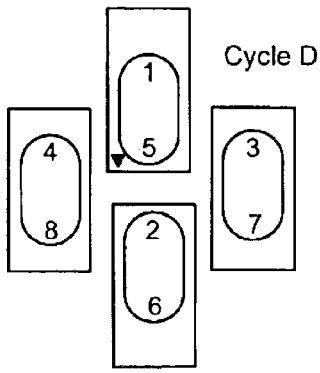

The design A.4 engine which has 4 two-way double parallel rail type cylinders operates as follows:

FIG. 19 Cycle A Pistons (4), (7) ascend to the highest point. Pistons (8), (3) descend to the lowest point.

Pistons (1), (2), (5), (6) are at the middle

Cycle B Pistons (1), (6) ascend to the highest point. Pistons (5), (2) descend to the lowest point.

Pistons (3), (4), (7), (8) are at the middle

Cycle C Pistons (3), (8) ascend to the highest point. Pistons (7), (4) descend to the lowest point.

Pistons (1), (2), (5), (6) are at the middle

Cycle D Pistons (2), (5) ascend to the highest point. Pistons (6), (1) descend to the lowest point.

Pistons (3), (4), (7), (8) are at the middle

FIG. 19.1 The piston (4) is set to be at the ignition position in cycle A.

FIG. 19.2 The piston (6) is set to be at the ignition position in cycle B.

FIG. 19.3 The piston (8) is set to be at the ignition position in cycle C.

FIG. 19.4 The piston (2) is set to be at the ignition position in cycle D.

FIG. 19.5 The piston (7) is set to be at the ignition position in cycle A.

FIG. 19.6 The piston (1) is set to be at the ignition position in cycle B.

FIG. 19.7 The piston (3) is set to be at the ignition position in cycle C.

FIG. 19.8 The piston (5) is set to be at the ignition position in cycle D.

The operation of the design A.4 engine which is of 4 parallel rail type cylinders is that in every cycle A, cycle B, cycle C, cycle D, each time there is one piston provides ignition and in one rotation of the shaft, there are 4 times of ignition and the piston will complete its operation cycle when the shaft rotates two turns in the same manner as a general 4-stroke engine. The torque derived from the parallel-rail type engine of design A.4 provides continuous power at every 90 degrees of the rotation of the transmission shaft.

Figure 9:
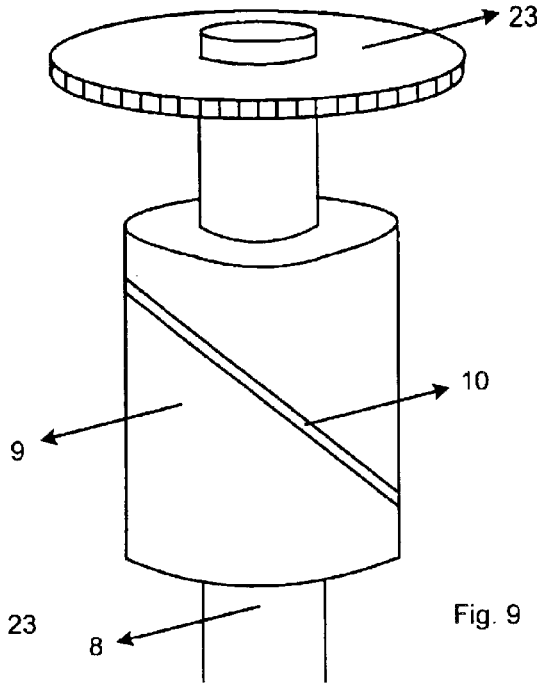
FIG. 9 A guide rail platform used with a 2-cylinder engine, and a 4-cylinder engine.

The transmission of power to the shaft in the design A.4 engine which has 2 cylinders is through a connecting rod arm to a guide rail platform which is fixedly attached to the transmission shaft. The rails in the guide rail platform of the design A.4 engine which has 2 cylinders are of a rail type, one is fitted at the highest position and one is fitted at the lowest position in the opposite direction on the platform. The rails are inclined from the highest position to the lowest position and from the lowest position to the highest position in one cycle of the guide rail platform (FIG. 9).

Referring to the guide rail platform of the design A.4 engine which has 4 cylinders, the rails in the guide rail platform can have various embodiments. For example:

A single rail having two points for the highest positions and two points for the lowest positions on the same guide rail platform. The highest positions are opposite to each other and the lowest positions are opposite to each other.

The highest position forms an angle of 90 degrees and 270 degrees with the center of the guide rail platform.

The lowest position forms an angle of 180 degrees and 360 degrees with the center of the guide rail platform.

Figure 10:
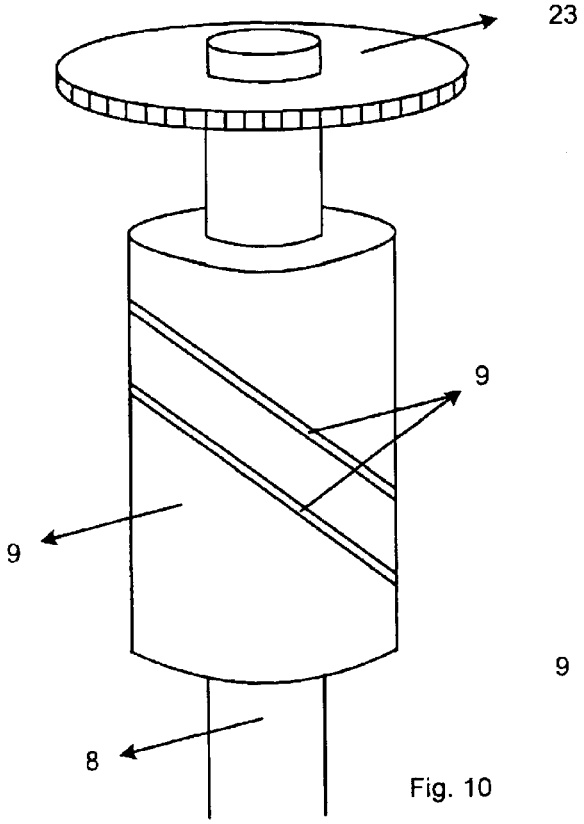
FIG. 10 A guide rail platform used with a parallel rail type 4-cylinder engine.
Figure 11:
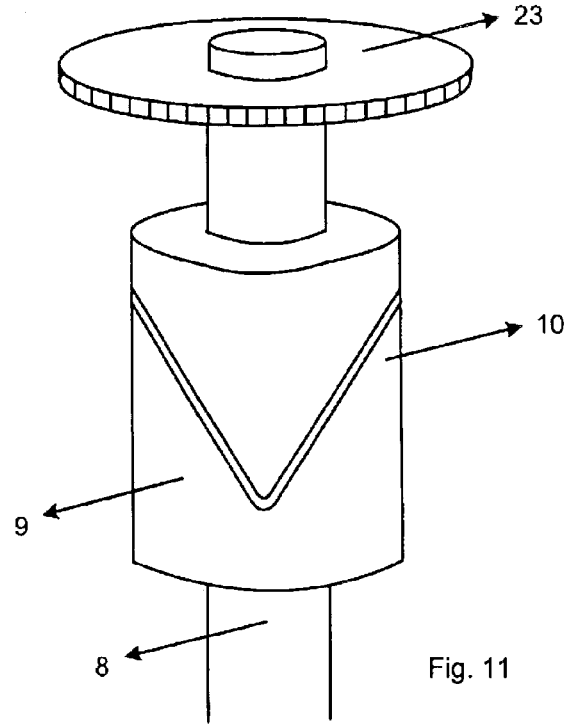
FIG. 11 A guide rail platform used with a single rail type 4-cylinder engine.

Parallel rails having a form similar to the design A.4 engine which has 2 cylinders. The rails are parallel along the same platform and the position for placing two-way cylinders is similar to the design A.4 engine which has 4 single-rail type cylinders (FIG. 10)

The disclosed two-way engine can operate as a two-stroke engine with suitable ports and this two-way engine can perfectly operate as a four-stroke diesel engine.

Any other modifications can be performed to the engine by any person skilled in the pertinent art or science without departing from the scope and objects of the present invention as stated in the claims.

BEST MODE OF THE INVENTION

As described in the heading of the full disclosure of an engine invention.

What is claimed is:

1. An internal combustion engine comprising:

a dual cylinder having an upper cylinder chamber and a lower cylinder chamber;

an upper piston in the upper cylinder chamber and a lower piston in the lower cylinder chamber;

a connecting rod connected to the upper piston and lower piston for common movement of the pistons during intake, compression, power, and exhaust strokes;

said connecting rod having a laterally extending arm connected with means for producing rotation of a crankshaft when the connecting rod moves linearly during travel of the pistons in the cylinder chambers in said power strokes thereof;

a guide connected to said laterally extending arm of the connecting rod to undergo rotation during the power strokes of the pistons, said cylinder having upper and lower cylinder heads having respective intake and exhaust ports;

a rotor located at each of said upper and lower cylinder heads, said rotor being driven in rotation with said guide as the connecting rod moves linearly;

each said rotor having an opening which successively communicates with said intake and exhaust ports as the rotor rotates.

2. The internal combustion engine of claim 1, wherein said connecting rod and said crankshaft extend perpendicular to one another.

3. The internal combustion engine of claim 1, wherein said dual cylinder is arranged vertically and said upper and lower pistons respectively ascend and descend during their respective strokes, wherein when said upper pistons ascends to its highest position to complete the compression stroke, the lower piston descends to its lowest position to complete its intake stroke, when said upper piston descends to its lowest position to complete its power stroke, the lower piston ascends to its highest position to complete its compression stroke, when said upper piston ascends to its highest position to complete its exhaust stroke, the lower piston descends to its lowest position to complete its power stroke, and when said upper piston descends to its lowest position to complete its intake stroke, the lower piston ascends to its highest position to complete the exhaust stroke.

4. The internal combustion engine of claim 1, wherein each of said upper and lower cylinder heads includes outer and inner spaced walls between which a respective said rotor rotates.

5. The internal combustion engine of claim 1, wherein said means for producing rotation of a crankshaft comprises a further connecting rod connected to the first said connecting rod for being driven linearly therewith and a crank connected to said further connecting rod for driving the crankshaft.

6. The internal combustion engine of claim 1, wherein a plurality of said dual cylinders with their respective said pistons and connecting rods are arranged around said guide in symmetrical equiangular relation to provide synchronized strokes of said pistons and continuous balanced rotation of said guide.

7. The internal combustion engine of claim 6, wherein said plurality of pistons are arranged in pairs in which the dual cylinders in each pair are disposed in a common plane.

8. The internal combustion engine of claim 1, wherein said openings in said rotors comprise curved slots.

9. The internal combustion engine of claim 8, wherein said ports in said upper and lower cylinder heads comprise curved slots.

10. The internal combustion engine of claim 9, wherein said slots in said rotors are arranged to successively communicate with the slots in the cylinder heads as the rotors rotate.

11. The internal combustion engine of claim 1, wherein said laterally extending arm on said connecting rod is engaged in a rail extending around said guide.

12. The internal combustion engine of claim 11, wherein said rail extends around said guide and provides high and low points corresponding to respective ends of the power strokes of the pistons.

13. The internal combustion engine of claim 12, wherein at said high and low points, one of the pistons is at the begining of its power stroke and the other of the pistons is at the end of its intake stroke, said pistons traveling in synchronized opposition to one another.

14. The internal combustion engine of claim 1, comprising a second dual cylinder with respective said upper and lower pistons and connecting rod, said second dual cylinder extending parallel to the first of said dual cylinder and connected via said guide for synchronized operation therewith.

15. The internal combustion engine of claim 14, wherein the arms of the connecting rods of the first and second dual cylinders are both drivingly connected to said guide.

16. The internal combustion engine of claim 14, wherein said arms of said connecting rods are engaged in respective rails extending around said guide.

17. The internal combustion engine of claim 1, wherein said means for producing rotation of said crankshaft comprises a transmission shaft secured to said guide for rotation therewith.

18. The internal combustion engine of claim 17, wherein said transmission shaft extends parallel to said connecting arm.

19. The internal combustion engine of claim 17, wherein said rotors are connected to said transmission shaft for being driven thereby.

20. The internal combustion engine of claim 19, comprising a gear assembly drivingly connecting said transmission shaft and said rotors.

21. The internal combustion engine of claim 20, wherein said gear assembly comprises first gears fixed to said transmission shaft for rotation therewith and second gears secured to said rotors and in mesh with said first gears.

* * * * *